US007252423B1

(12) United States Patent
Wang

(10) Patent No.: US 7,252,423 B1
(45) Date of Patent: Aug. 7, 2007

(54) CANDLE WITH MAGNETICALLY ACTIVATED INTERNAL ILLUMINATION

(75) Inventor: Wen Der Wang, Wilmington, MA (US)

(73) Assignee: The Schawbell Corporation, Bedford, MA (US)

( * ) Notice: Subject to any disclaimer, the term of this patent is extended or adjusted under 35 U.S.C. 154(b) by 0 days.

(21) Appl. No.: 11/349,293

(22) Filed: Feb. 6, 2006

Related U.S. Application Data

(63) Continuation-in-part of application No. 10/926,525, filed on Aug. 26, 2004, now Pat. No. 7,098,600.

(30) Foreign Application Priority Data

Nov. 25, 2003 (CN) ..... 2003 2 0115105

(51) Int. Cl.
*F21V 5/00* (2006.01)

(52) U.S. Cl. ..... 362/569; 362/392; 362/802; 362/810

(58) Field of Classification Search ..... 362/392, 362/393, 569, 802, 810
See application file for complete search history.

(56) References Cited

U.S. PATENT DOCUMENTS 3,890,085 A * 6/1975 Andeweg ..... 362/569
6,053,622 A * 4/2000 Horowitz et al. ..... 362/802
7,098,600 B2 * 8/2006 Li et al. ..... 362/161
7,121,686 B1 * 10/2006 Chu ..... 362/810

* cited by examiner

*Primary Examiner*—Stephen F Husar
(74) *Attorney, Agent, or Firm*—Levisohn Berger LLP

(57) ABSTRACT

A candle and base combination with a decorative light element is provided. The candle body preferably has a first substantially opaque section and a second at least partially translucent section, and at least one hollow portion formed in the second section. The base body has at least one protrusion fittable into the hollow portion. The wick projects from the first section of the candle body. A light emitting device is disposed in one of the base body or the main candle body in the second section, the light emitting device having associated therewith a magnetic switch closable in the presence of a magnetic field. A magnet is disposed in the other of the base body or the main candle body in the second section. When the main candle body is placed on the base body and the magnet is aligned with the magnetic switch, the light emitting device is activated.

16 Claims, 7 Drawing Sheets

CANDLE WITH MAGNETICALLY ACTIVATED INTERNAL ILLUMINATION

RELATED APPLICATIONS

This is a Continuation-in-Part of U.S. patent application Ser. No. 10/926,525 filed Aug. 26, 2004, now U.S. Pat. No. 7,098,600 which claims priority from Chinese Patent Application No. 2003-20115105.9 filed Nov. 25, 2003.

BACKGROUND

1. Field of the Invention

The invention relates to candles, and more specifically to decorative candles having an auxiliary decorative internal source of illumination.

2. Description of the Related Art

A candle usually emits light by the burning of its wick, however its use as a primary lighting instrument has been reduced with the popularization of electric light. Therefore, the candle is currently used more frequently as decoration.

As a result of this trend, there have emerged a number of decorative and entertainment candle-related products, one example of which can be found in Chinese Patent No. 02233525.0. This patent teaches a candle-based product having a flashing function having a candle and a base tray. The candle is rooted on the base tray, and the tray includes an integrated circuit, power supply, and light emitting diode (LED). The integrated circuit and LED are fixed on the base tray. An aluminum wire/foil core is used as lighting circuit switch; while the switch is closed, the candle will flash. A major drawback is that the aluminum core here is made from two small aluminum foil bars with a layer of insulating material between them set parallel with the wick. The insulating material is vaporized by the flame of the wick, and the aluminum foil bars will be connected and form a circuit. However, burnt ash will remain from the combustion of the insulating material and the melting of the aluminum, and this negatively affects the candle's ability to provide decoration and view. More importantly, after the candle is shut off, the two pieces of aluminum must be pulled apart manually as they remain fused together, and thus the circuit remains closed. Finally, as with ordinary candles, some kind of smoke can be formed during operation, especially if the wick burns all the way down to the LEDs.

An improvement to this design is disclosed in U.S. patent application Ser. No. 09/758,179, published Jul. 18, 2002 with Publication No. 2002/0093834 (now abandoned). This application discloses the use of an optical fiber to conduct light from a flame on the wick to a photosensor switch on the LED base. When a flame is present, the LED light show is activated, and when the flame is extinguished, the LEDs go out as well. This design and the one mentioned above suffer from a major deficiency. Since the wax of the candle is designed to be light transparent, light from the flame easily enters and permeates the wax, thereby washing out the light emanating from the LEDs in the base of the candle. The light show effect is thereby diminished by the very trigger mechanism that activates it (the flame), and the result is not very impressive.

One major improvement to this area can be found in U.S. patent application Ser. No. 10/926,525 (the parent application listed above) by some of the same inventors and owned by the same assignee, the entirety of which is incorporated by reference herein. It describes a candle with an LED light show in the base having a first relatively opaque zone in the upper portion of the candle near the flame and a second relative translucent zone in the lower portion of the candle near the base. When the flame is lighted, the upper portion of the candle does not transmit the glow of the flame down into the candle body, so that the LED light show in the base of the candle can shine prominently through the more light-transmissible portion. However, activation of the LED light show is dependent on the presence of a flame atop the candle; no flame, no LED light show.

SUMMARY OF THE INVENTION

The invention includes a candle and a decorative light element including a candle body having a first substantially opaque section and a second at least partially translucent section, and at least one hollow portion formed in the second section. A wick is disposed in the main candle body and projecting from the first section. A base body is provided having at least one protrusion fittable into the hollow portion. A light emitting device is disposed either on the base body or in the main candle body in the second section. The light emitting device has associated therewith a magnetic switch closable in the presence of a magnetic field. A magnet is disposed in the other of the base body or the main candle body in the second section. When the main candle, body is placed on the base body and the magnet is aligned with the magnetic switch, the light emitting device is activated. Light emitted from the light emitting device is at least partially visible though the second translucent section, and light from a flame on the wick is substantially not transmitted through the first opaque section of the main body.

In a preferred embodiment, the light emitting device is disposed on the protrusion and projects into the hollow portion of the candle body when the candle body is placed on the base body. A first indicator is preferably formed on the candle body and a second indicator formed on the base body, so that when the first and second indicators are aligned, the light emitting device is activated.

A second hollow portion may be formed in the candle body to correspond with a second protrusion formed on the base body fittable into the second hollow portion. The second hollow portion and the second protrusion are matingly engageable to secure the candle body to the base body.

The light emitting device preferably includes at least one light emitting diode (LED), and more preferably includes multiple LEDs, each of the multiple LEDs being a different color. A control circuit is provided to govern the sequence of illumination of each of the LEDs, each for a predetermined period of time. Preferably, the control circuit illuminates more than one of the LEDs of different colors at the same time during at least a portion of the sequence so as to produce an appearance of a color of light different from any single color of any of the LEDs (e.g., a red LED illuminated with a blue LED casts a purplish glow; a blue LED illuminated with a yellow LED casts a green glow, etc.).

In another embodiment, the invention includes a candle and base combination having a candle body having a hollow portion formed on the bottom and a base body having a protrusion fittable into the hollow portion. A wick is disposed in the main candle body and projecting from the top of the candle body. A light emitting device is disposed either on the base body or in the bottom of the main candle body, and has associated therewith a magnetic switch closable in the presence of a magnetic field. A magnet is disposed in/on the other of the base body or the bottom of the main candle body. When the main candle body is placed on the base body and the magnet is aligned with the magnetic switch, the light emitting device is activated.

In both embodiments, it is preferred that the magnet is embedded in the second section of the candle body. A shield is preferably fittable into the hollow portion and fittable around the protrusion and more preferably includes a magnet holder, wherein the magnet is disposed in the magnet holder. The shield further includes fins to anchor the shield into the candle body.

The inventive candle resolves the issues mentioned above; the candle is capable not only of lighting but also of providing a colorful flashing performance which is interesting and beautiful. Further, the light show in the base is independently operable from the presence of a flame but has no visible ugly switch mechanism to mar the sleek appearance of the base or candle. The inventive candle may be provided in a transparent container, such as a glass jar.

The effective benefits with the scheme mentioned above are as follows. First, since the wick projects from the substantially opaque portion of the candle, the light show in the substantially light-transmissible portion is not washed out by or interfered with by the light of the flame of the wick. Further, because the electronic light emitting device is directly controlled by positioning the candle so that the magnet is moved into or out of proximity to the magnetic reed switch, there is no need for a light pipe or other such flame-sensing structure to be embedded in the candle body, and thus no ash residue is created that would spoil the decorative function of the candle. Moreover, it is also possible (although not required) to dispose the candle within a glass container which will introduce more attractiveness as more colorful light will be sent out, while at the same time containing the candle nicely. The use of a flame barrier between the bottom of the candle and the light emitting device prevents the light emitting device from catching fire; since the light emitting device is mostly made of plastic, avoiding its combustion is quite desirable.

DETAILED DESCRIPTION OF EMBODIMENTS OF THE INVENTION

The invention will be now be described with reference to the attached FIGS. 1-8. It should be noted that these figures are exemplary in nature and in no way serve to limit the scope of the invention, which is defined by the claims appearing hereinbelow and their reasonable equivalents.

The basic components of the invention include candle base 10 and candle 20, which is placeable and relatively securable atop base 10. Candle 10 may be made from wax, paraffin, or any other material from which candles may be made or have been made.

Figure 1:
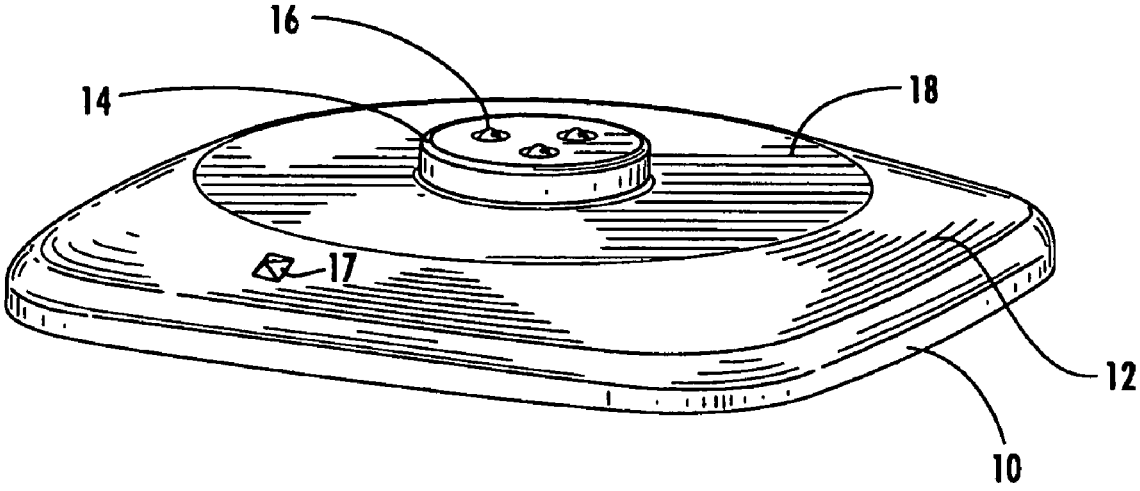
FIG. 1 is a perspective view of an embodiment of a base in accordance with the inventive candle and base combination.
Figure 2:
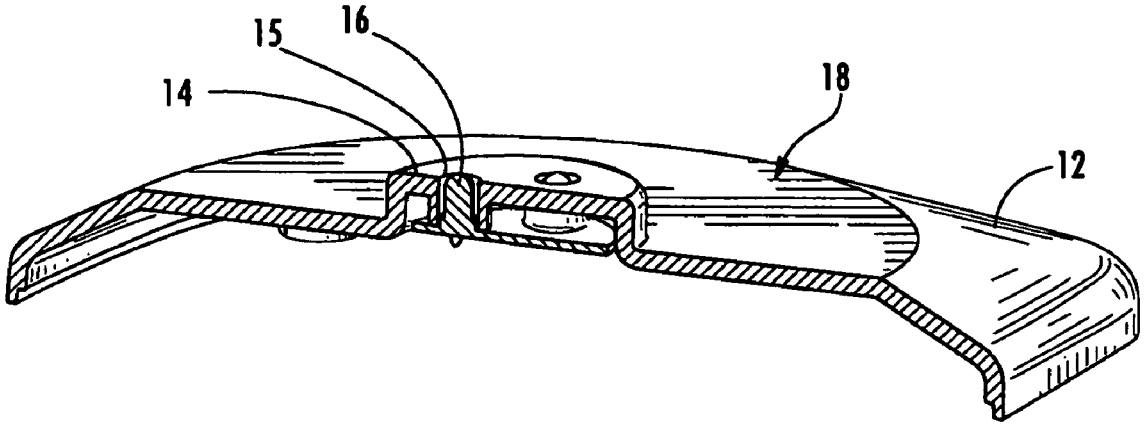
FIG. 2 is a sectional view of the base of FIG. 1.

As best shown in FIGS. 1 and 2, base 10 includes a main base body 12 having a protrusion 14 projecting upward therefrom. In the embodiment shown, a light emitting device in the form of several LEDs 16 are recessed within protrusion 14; LEDs 16 may be positioned anywhere on or in protrusion 14 so long as at least a portion of each of the LEDs is not covered and able to shine light into a candle placed above it. Around or otherwise near protrusion 14 is surface 18 which is adapted to receive and support the bottom of a candle. As shown in FIG. 1, surface 18 is flat and annular, however any shape of surface may be utilized, as long as the bottom of the candle to be placed thereon is correspondingly shaped.

Figure 8:
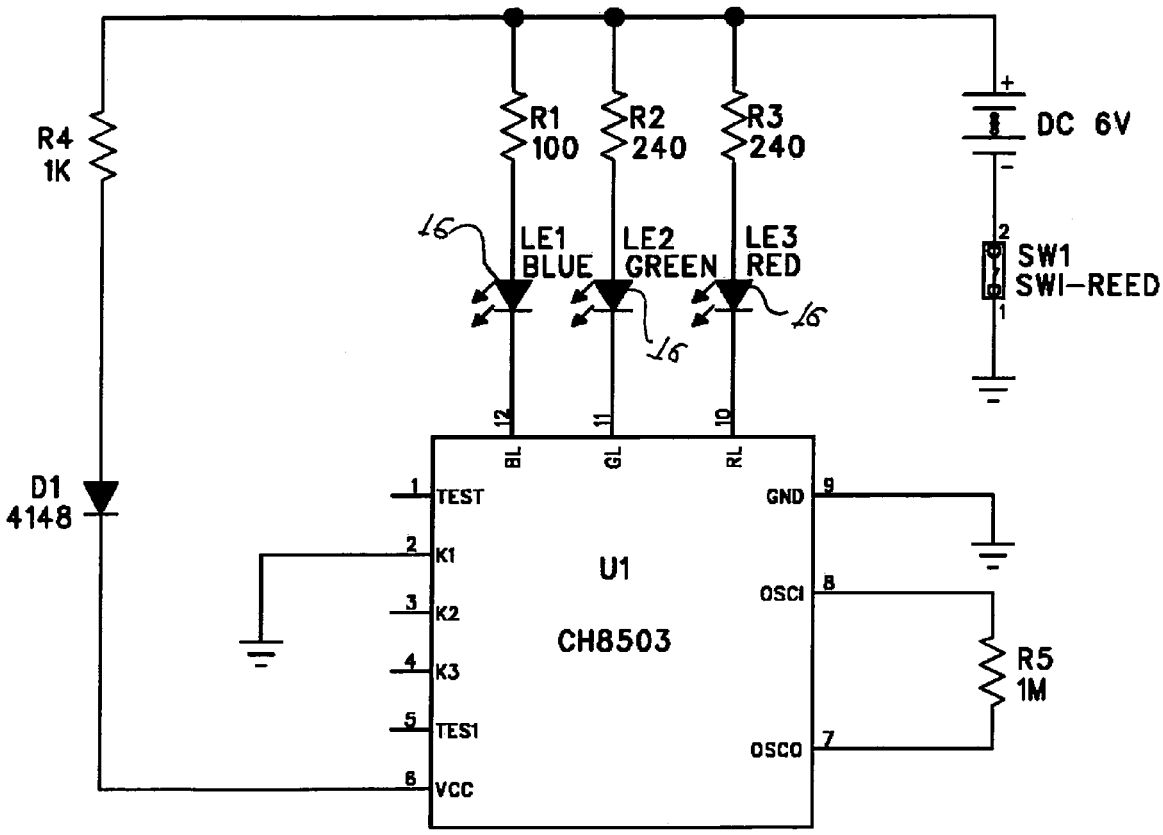
FIG. 8 is a circuit diagram showing the light-emitting device, its control circuit, and the associated magnetic switch in accordance with the invention.

A circuit diagram showing one embodiment of the light emitting device is shown in FIG. 8. In addition to a number of LEDs 16, the circuit includes a magnetically activatable switch SW1, which is preferably a magnetic reed switch. Switch SW1 is of the type that closes in the presence of a magnetic field. Thus, when a magnetic field is applied to switch SW1, the switch closes, and current flows to the LEDs and the control circuit. The significance of switch SW1 will be discussed below.

Figure 3:
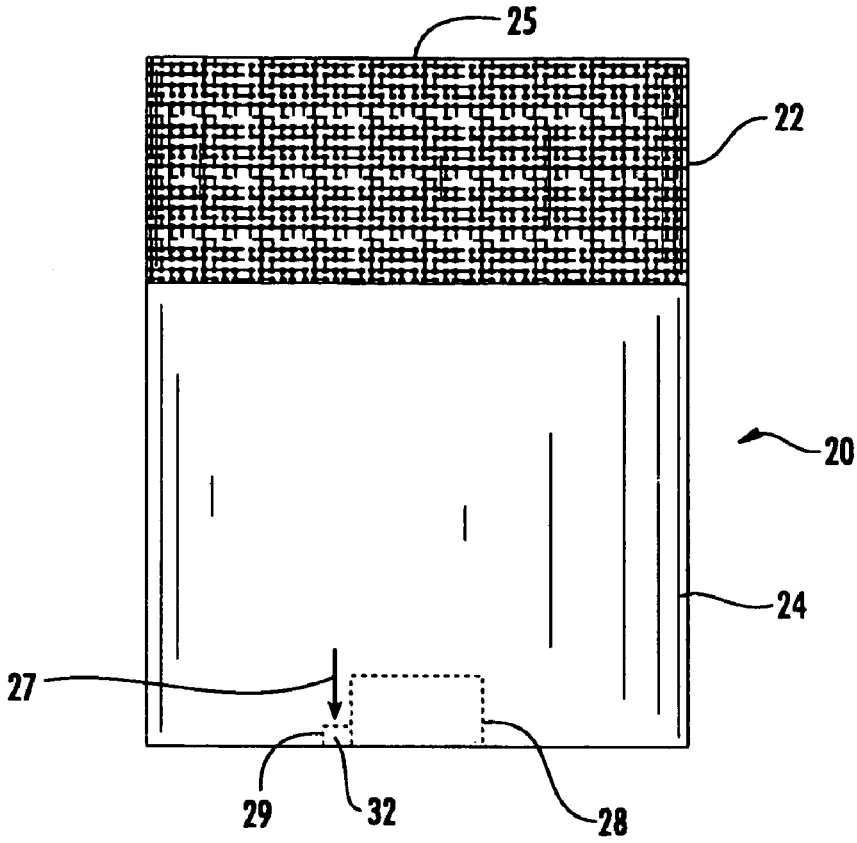
FIG. 3 is an elevational view of an embodiment of a candle in accordance with the inventive candle and base combination.
Figure 7:
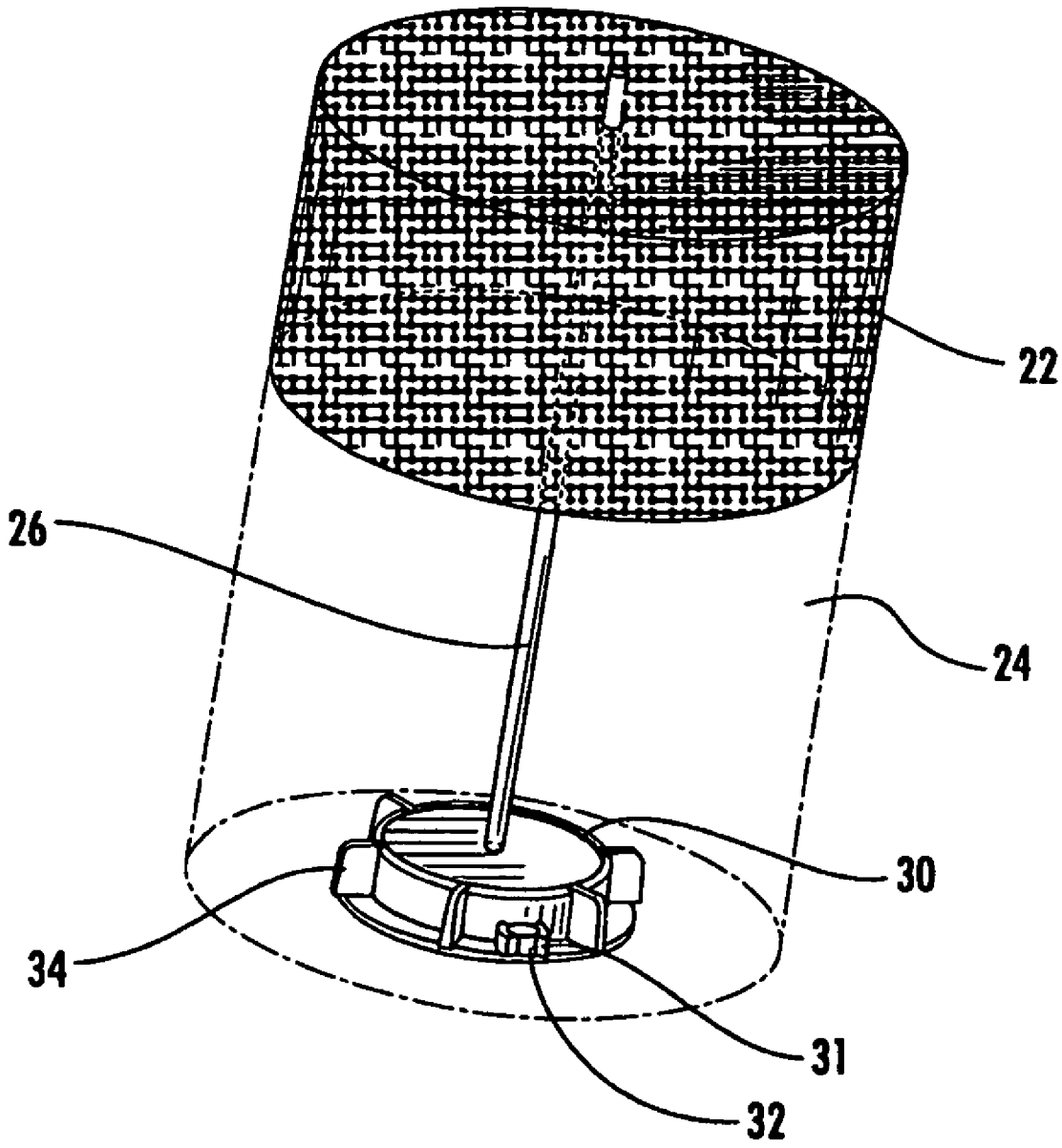
FIG. 7 is a partially transparent perspective view of another embodiment of a candle in accordance with the inventive candle and base combination.

A preferred embodiment of candle 20 is shown in FIGS. 3 and 7. The main body of candle 20 is preferably provided with two regions or sections, opaque section 22 and translucent section 24. A conventional wick 26 protrudes from opaque section 22, and a hollow portion 28 is formed in translucent section 24. It is preferred to dye the portion of the candle from which the wick 26 projects to be substantially opaque so that the light from the flame on the wick does not bleed into and thus interfere with the light generated by the light emitting device. Conversely, it is preferred that translucent section 24 is as light-permeable as possible so that as much of the light from the light emitting device is visible as possible.

Figure 4:
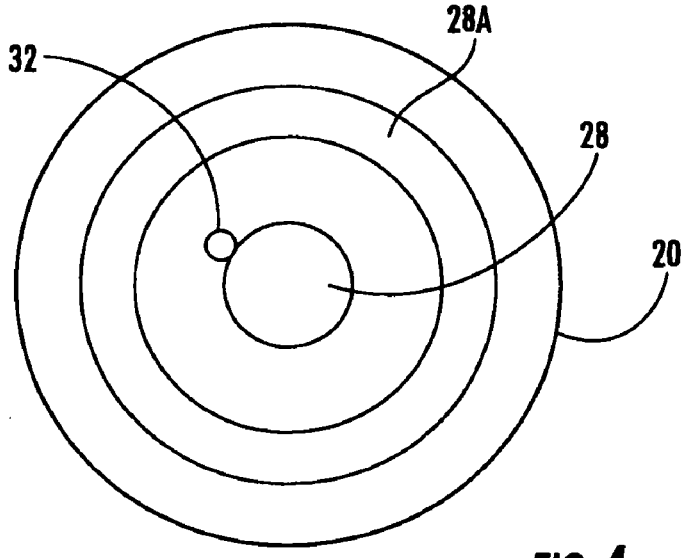
FIG. 4 is a bottom elevation view of an alternative embodiment of a candle in accordance with the inventive candle and base combination.

Hollow portion 28 is designed to accept or receive protrusion 14 when candle 20 is placed upon base 10. Hollow portion 28 may include an auxiliary hollow portion 29 which is configured to receive magnet 32 to be embedded in candle 20. FIG. 4 depicts an alternative embodiment of the candle, which has not only hollow portion 28 and embedded magnet 32 but also a second hollow portion 28A. The purpose of hollow portion 28A is to provide additional support for the candle when it is positioned on base 10; hollow portion 28A is designed to mate with a corresponding second protrusion on base 10. The exemplary hollow portion 28A is shown to be annular; the second protrusion may also be annular, or semi-annular, or some arc-shaped protrusion, or may even be a simple post or several posts which fit inside hollow portion 28A. It is preferred but not required that candle 20 be able to be rotated about its long axis whilst disposed on base 10 for the reasons stated below.

The provision of magnet 32 in the bottom of candle 20 enables the user to activate or deactivate the light emitting device simply by aligning or un-aligning magnet 32 with magnetic switch SW1. That is, in the embodiments shown, one may rotate the candle into proper alignment so that the magnetic field of magnet 32 closes switch SW1 to thereby cause the light emitting device to be activated. As shown in FIG. 3, the exterior of candle 20 may be provided with a marking or indicator 27 which can be aligned with a corresponding marking or indicator 17 on base 10 (see FIG. 1). When the two indicators 17 and 27 are aligned, switch SW1 is closed, and the light show of the light emitting device is visible through translucent section 24. When a flame is applied to wick 26, the light from the flame is blocked from entering translucent section 24 by opaque section 22; thus, the light from the flame is prevented from washing out and covering up the light show.

Figure 5:
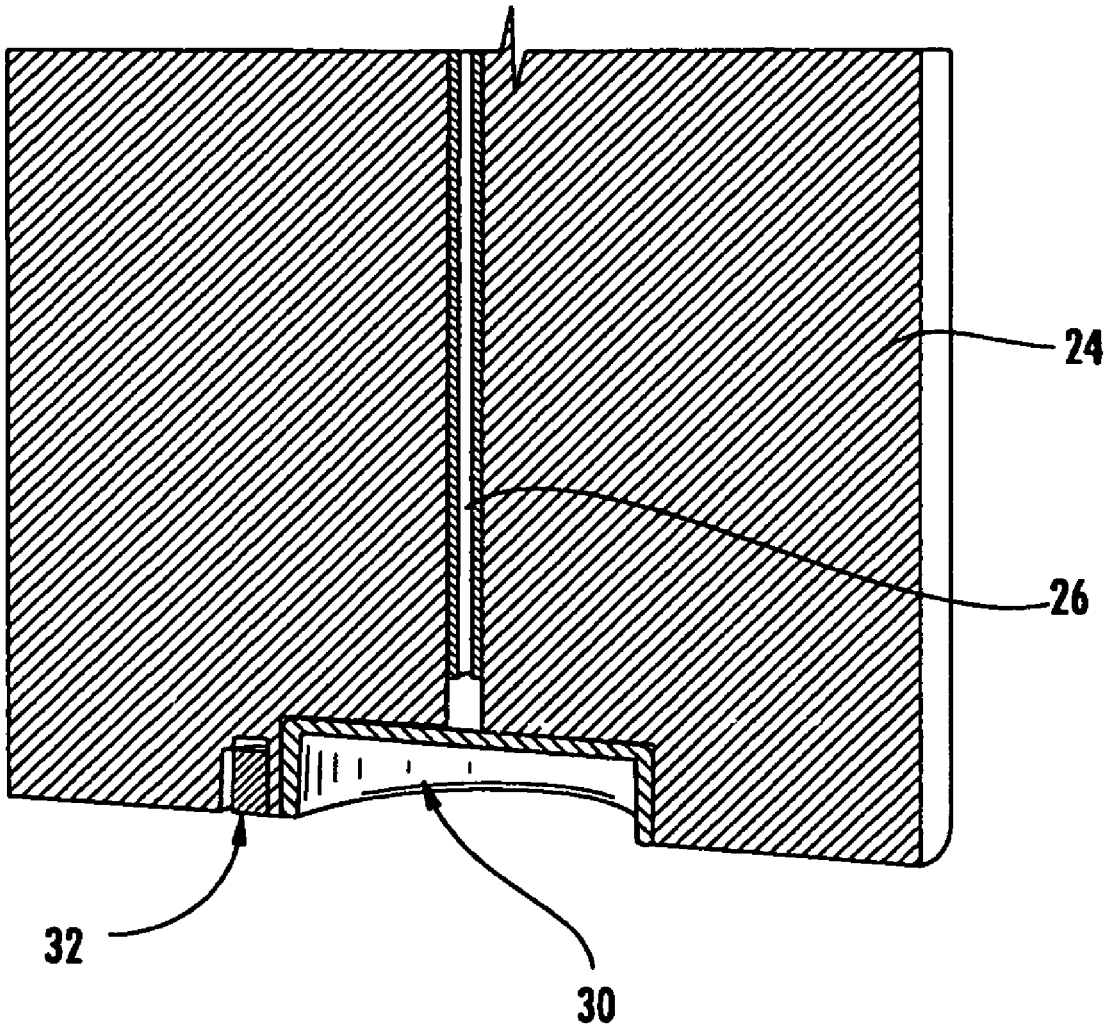
FIG. 5 is a partial sectional view of an embodiment of a candle in accordance with the inventive candle and base combination.
Figure 6:
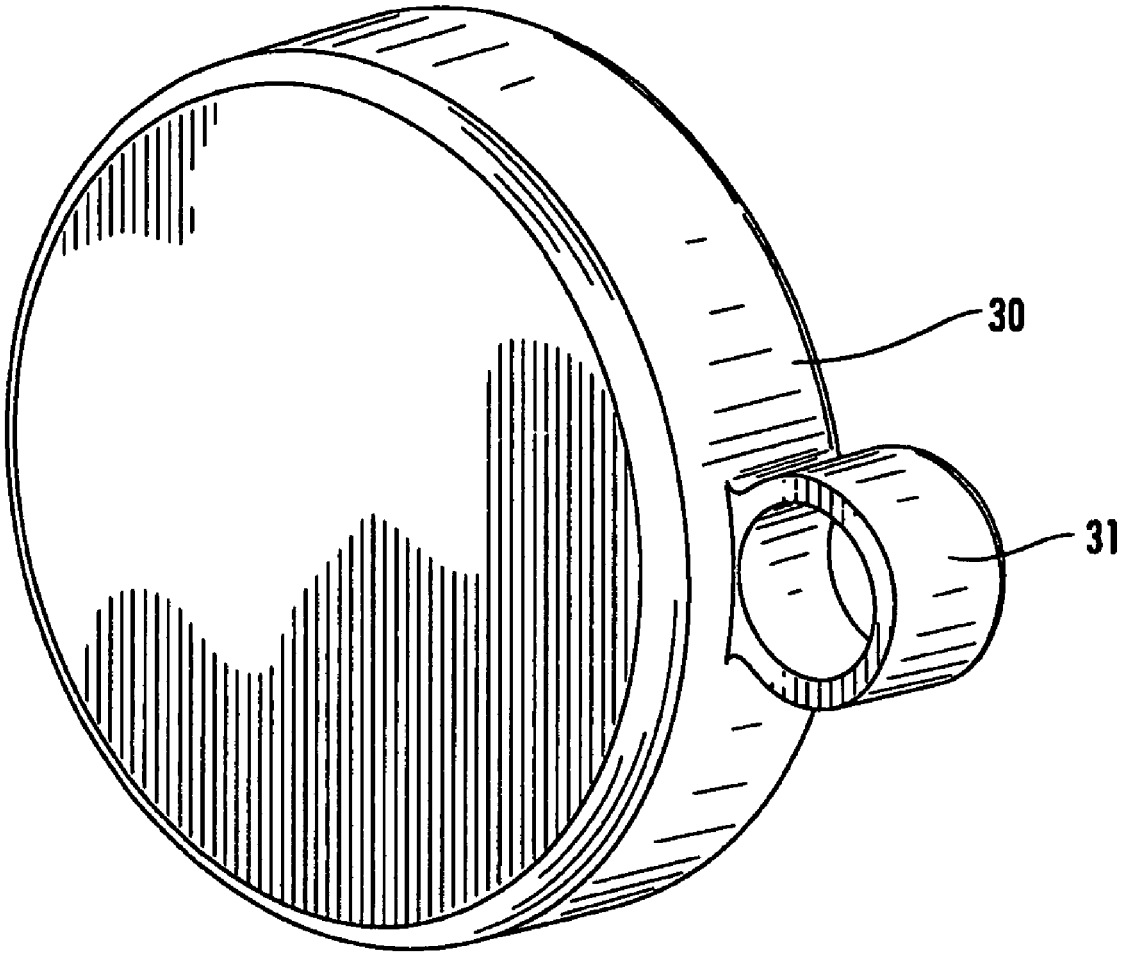
FIG. 6 is a top perspective view of one embodiment of an element of the inventive candle.

FIGS. 5-7 depict an optional element of the inventive candle and base combination: shield 30. Shield 30 is fitted into hollow 28 and acts as a flame barrier to protect the light emitting device from the flame of the wick or melting hot wax. (Shield 30 is configured to receive protrusion 14.) Optionally, as shown in FIG. 6, shield 30 may include a magnet holder 31 into which magnet 32 may be disposed more easily than simply embedding it into the candle body itself. As another option, as shown in FIG. 7, shield 30 may include fins 34 which serve to anchor shield 30 into the bottom of candle 20. That is, when shield 30 is pressed into hollow portion 28, fins 34 dig into the material of the candle and secure the shield in place. It is preferred that shield 30 be made substantially transparent so that light from the light emitting device can enter and diffuse into section 24 of candle body 20 without being filtered, impeded, or otherwise reduced in visibility. Preferred materials for the shield are plastic or glass (though plastic is typically less expensive).

The invention is not limited to the embodiments shown in the drawings. For example, the drawings depict a substantially cylindrical candle with a wick projecting from the top and the light emitting device disposed in the base. However, the wick may project from other surfaces of the candle, and the light emitting device may be disposed in other locations as well. Similarly, in the embodiments shown, opaque section 22 is the upper portion of the candle, and translucent section 24 is the lower portion of the candle; however other configurations are possible. What is relevant is that the wick projects from the opaque section and the light emitting device emits light into the translucent section. Similarly, the candle shown is cylindrical and the base is flat; however, any shape of candle may be employed without departing from the scope of the invention, as long as the magnet disposed in one of the base or the candle is relatively movable into and out of alignment with a magnetic switch on the other of the base and candle.

Having described the invention with respect to the above embodiments and drawings, it should be noted that the scope of the invention is not limited to the above description or what is shown in the drawings but rather is defined by the claims appearing hereinbelow and all such equivalents.

What is claimed is:

1. A candle and base combination, comprising:

a candle body having a first substantially opaque section and a second at least partially translucent section, and at least one hollow portion formed in said second section;

a base body having at least one protrusion fittable into said hollow portion;

a wick disposed in said main candle body and projecting from said first section;

a light emitting device disposed one of on said base body or in said main candle body in said second section, said light emitting device having associated therewith a magnetic switch closable in the presence of a magnetic field;

a magnet disposed the other of on said base body or in said main candle body in said second section, wherein when said main candle body is placed on said base body and said magnet is aligned with said magnetic switch, said light emitting device is activated.

2. A candle and base combination according to claim 1, wherein said light emitting device is disposed on said protrusion and projects into said hollow portion of said candle body when said candle body is placed on said base body.

3. A candle and base combination according to claim 1, further comprising a first indicator formed on said candle body and a second indicator formed on said base body, wherein when said first and second indicators are aligned, said light emitting device is activated.

4. A candle and base combination according to claim 1, further comprising:

a second hollow portion formed in said candle body, and a second protrusion formed on said base body fittable into said second hollow portion, wherein said second hollow portion and said second protrusion are matingly engageable to secure said candle body to said base body.

5. A candle and base combination according to claim 1, wherein said magnet is embedded in said second section.

6. A candle and base combination according to claim 1, further comprising a shield fittable into said hollow portion and fittable around said protrusion.

7. A candle and base combination according to claim 6, said shield further comprising a magnet holder, wherein said magnet is disposed in said magnet holder.

8. A candle and base combination according to claim 6, said shield further comprising fins to anchor said shield into said candle body.

9. A candle and base combination according to claim 1, wherein light emitted from said light emitting device is at least partially visible though said second section and light from a flame on said wick is substantially not transmitted through said first section of said main body.

10. A candle and base combination according to claim 1, wherein said light emitting device comprises at least one light emitting diode (LED).

11. A candle and base combination according to claim 10, wherein said light emitting device comprises multiple LEDs, each of said multiple LEDs being a different color.

12. A candle and base combination according to claim 11, said light emitting device further comprising a control circuit.

13. A candle and base combination according to claim 12, wherein a sequence of each of said LEDs illumination is governed by said control circuit.

14. A candle and base combination according to claim 13, wherein said control circuit illuminates each of said LEDs for a predetermined period of time.

15. A candle and base combination according to claim 14, wherein said control circuit illuminates more than one of said LEDs of different colors at the same time during at least a portion of said sequence so as to produce an appearance of a color of light different from any single color of any of said LEDs.

16. A candle and base combination, comprising:

a candle body having a hollow portion formed on the bottom;

a base body having a protrusion fittable into said hollow portion;

a wick disposed in said main candle body and projecting from the top of said candle body;

a light emitting device disposed one of on said base body or in said bottom of said main candle body, said light emitting device having associated therewith a magnetic switch closable in the presence of a magnetic field;

a magnet disposed the other of on said base body or in said bottom of said main candle body, wherein when said main candle body is placed on said base body and said magnet is aligned with said magnetic switch, said light emitting device is activated.

* * * * *